US006139167A

United States Patent [19]

Chang

[11] Patent Number: 6,139,167

[45] Date of Patent: Oct. 31, 2000

[54] STERIC RETIFORM LAMP

[76] Inventor: Chih-Chen Chang, No. 32, Kuang Hua South, Hsinchu City, Taiwan

[21] Appl. No.: 09/223,798

[22] Filed: Dec. 31, 1998

[51] Int. Cl.[7] ..... F21W 121/04

[52] U.S. Cl. ..... 362/252; 362/123

[58] Field of Search ..... 362/252, 227, 362/249, 123

[56] References Cited

U.S. PATENT DOCUMENTS

| | | | |
|---|---|---|---|
| 2,468,773 | 5/1949 | Musinski | 362/249 X |
| 5,057,976 | 10/1991 | DuMong | 362/123 |
| 5,642,342 | 6/1997 | Chang | 362/227 X |
| 5,662,409 | 9/1997 | Huang | 362/123 X |
| 5,716,124 | 2/1998 | Hsu | 362/123 X |
| 5,823,659 | 10/1998 | Klose | 362/123 X |
| 5,944,408 | 8/1999 | Tong et al. | 362/252 |
| 5,971,563 | 10/1999 | Maggio | 362/123 X |

*Primary Examiner*—Laura K. Tso
*Attorney, Agent, or Firm*—Rosenberg, Klein & Lee

[57] ABSTRACT

A steric retiform lamp is provided where a string of lamps are connected into a meshwork forming a steric cylinder or cone shape. A cylindrical or a conical lamp network net is formed by a complete cord connecting all the bulbs in series, wherein the cord is constructed into a multiple-concentric-ring structure sequentially, by fastening the start end and the final end of the cord together. Each bulb-holder of the inner ring is linked to the adjacent external ring in a point to point wiring arrangement.

4 Claims, 3 Drawing Sheets

STERIC RETIFORM LAMP

BACKGROUND OF THE INVENTION

1. Field of the Invention

The present invention relates to a steric retiform lamp, and more particularly to a string of lamp connected into a meshwork forming a steric cylinder or cone shape.

2. Description of Prior Art

In accordance with the U.S. Pat. Nos. 5,662,409 and 5,645,342, they are provided with a string of plane retiform lamps having four cord terminals. If attaching them on a cylindrical or a conical object to construct a steric retiform lamp network, the four cord terminals have to be located. So actually a free steric lamp network is needed in the wider purposes of performance. Basing on this goal, the present invention is developed.

OBJECTS AND SUMMARY OF THE INVENTION

It is therefore a main object of the present invention to provide a steric retiform lamp connected by cords net into a graticule by several longitudinal wires and several latitudinal wires. It can be put on a cylindrical or a conical object, or hung upon a tree to decorate the object or the tree, and to simplify the mounting processes directly.

For archiving the objects, by means of a string of lamps connecting in series with a cord and keeping a constant space each other, the present invention provides a steric retiform lamp network, which is constructed by several concentric string lamp rings connecting each other sequentially. Wherein it fasten the start and final ends of the cords of each concentric string lamp ring together, and from the second ring, the two terminals of each bulb holder is bent and twisted into a certain length strand cable as a longitude, so the cord in the ring which was not twisted is made use for a latitude. According to the length used indeed, corresponding number of lamp rings is decided. Each bulb holder is provided for a nodal point fastening the longitudinal and latitudinal wire together so as to construct a steric lamp network.

DETAILED DESCRIPTION OF PRIFERRED EMBODIMENTS

Figure 1:
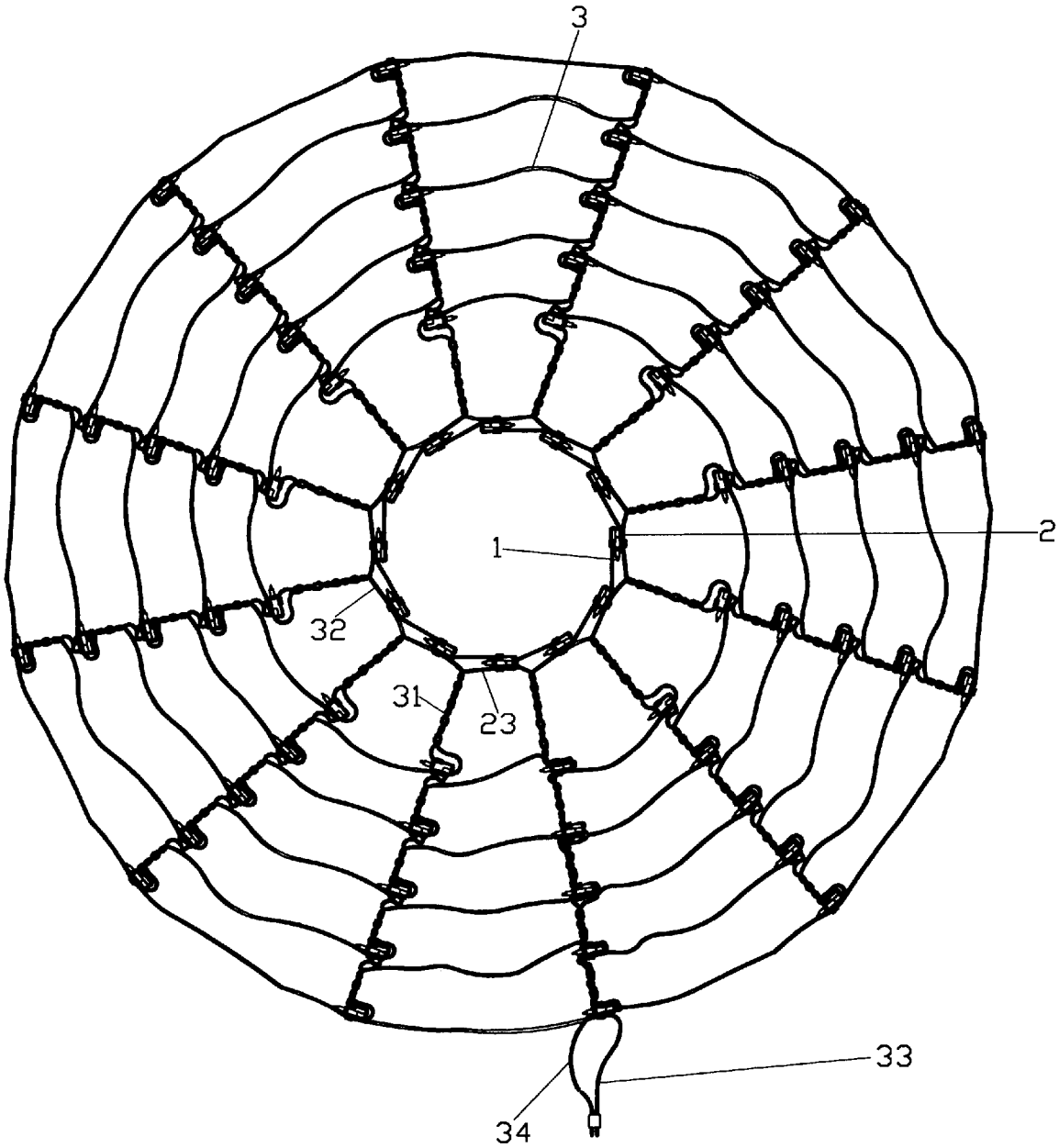
FIG. 1 is a plane view of the present invention.
Figure 2:
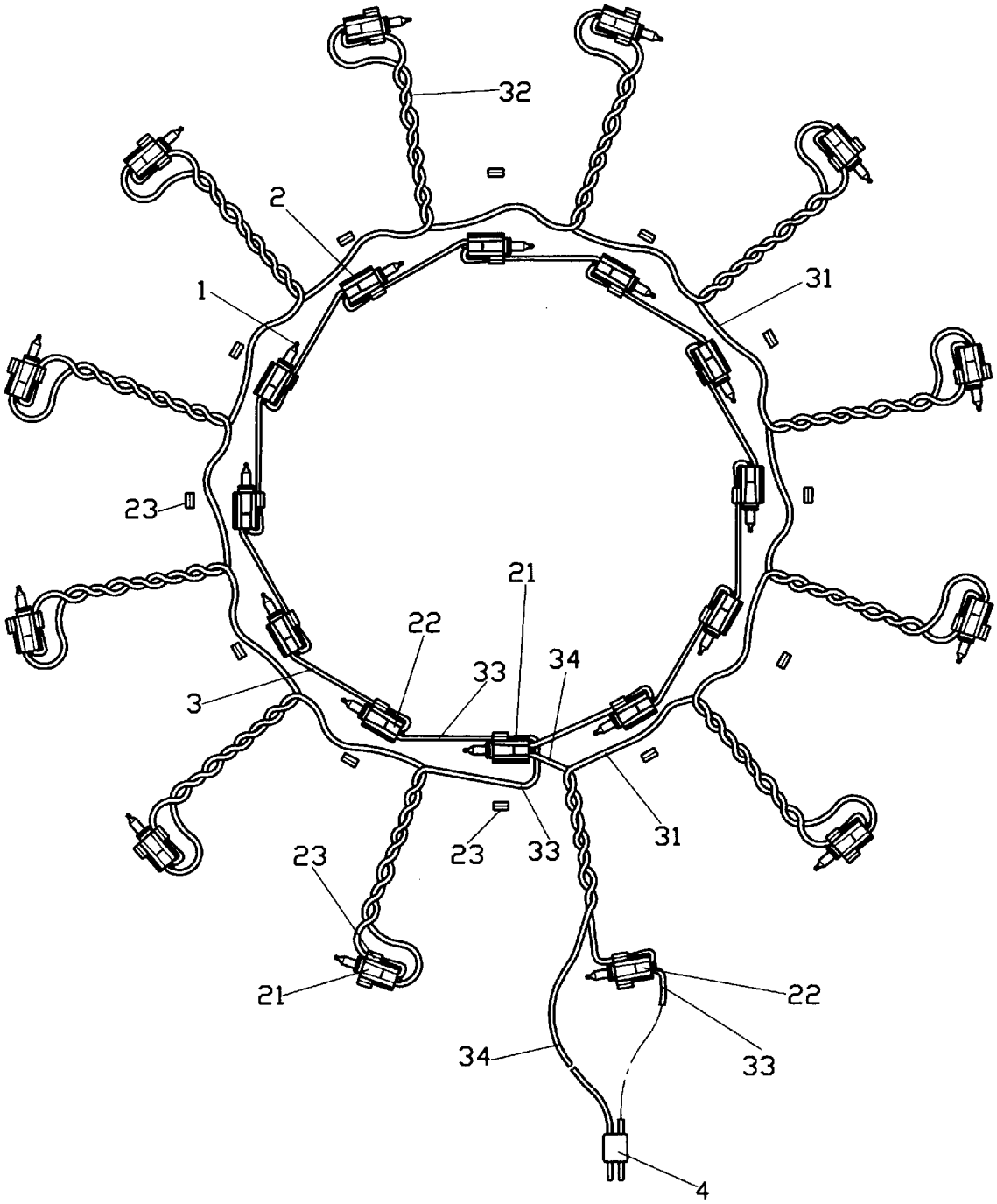
FIG. 2 is a plane view shown the combination of the present invention.
Figure 3:
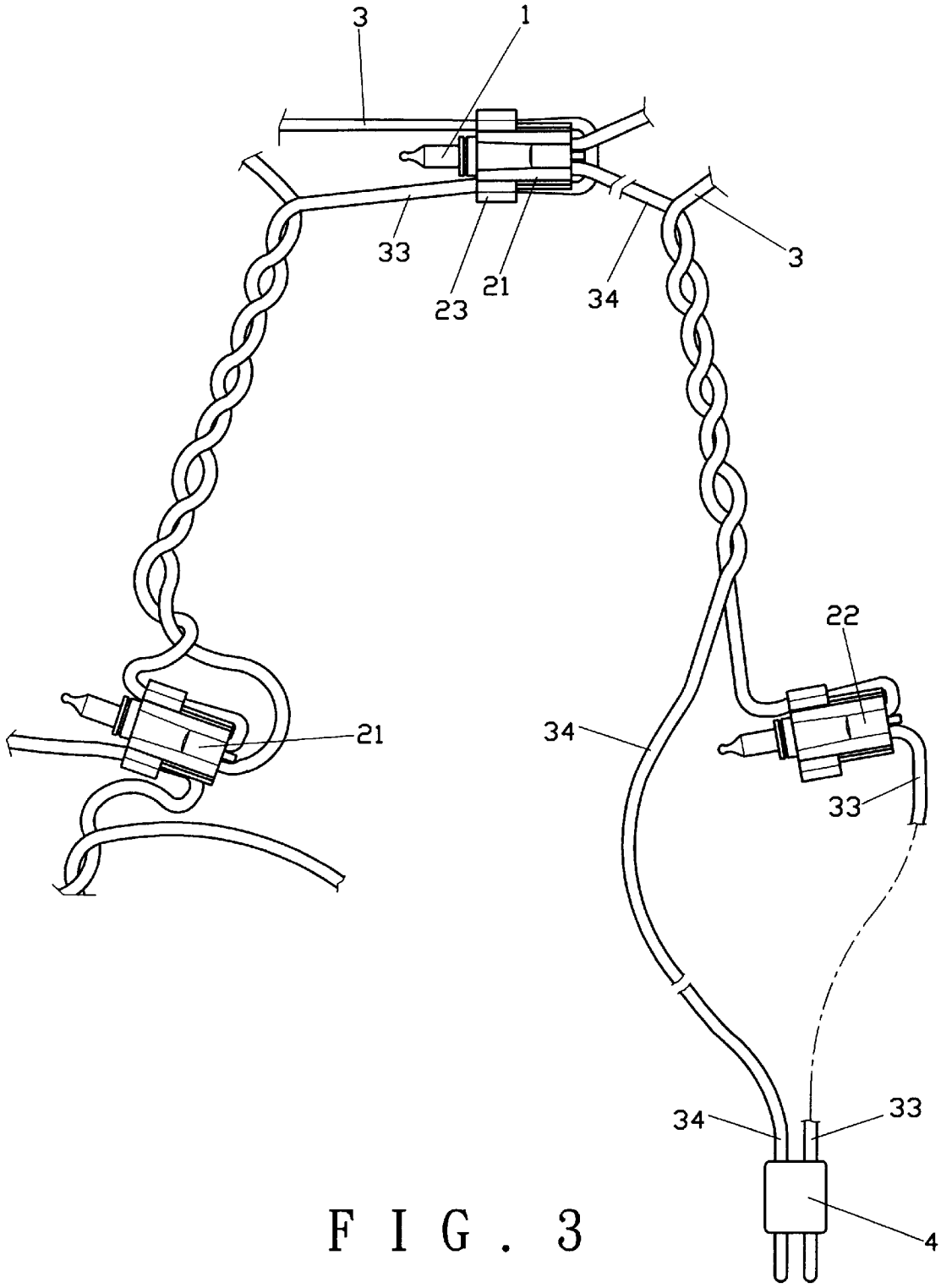
FIG. 3 is a part plane view shown the combination of the components of the present invention.

Referring to FIG. 1, the present invention is provided with a cylindrical or a conical lamp network net by a complete cord 3 connecting all the bulbs 1 in series. Netting longitudes 31 and latitudes 32 constructs said lamp network. Referring to FIG. 2 and FIG. 3, firstly the bulb-holders 2 with the bulb 1 are arrayed in series keeping a certain pitch with a cord 3. Then they are connected and formed into the first ring, wherein one terminal of the first bulb-holder 21 connects to one terminal of the plug 4 via a cord 34, and a rested cord 33 at the last bulb-holder 22 goes round the first bulb-holder 21, and is fastened with the first bulb-holder 21 at a proper position by a fastening component 33, then stretches downward continuously to connect with one terminal of the first bulb-holder 21 of the next concentric ring. The said rested cord 33 with a string of bulb-holders 2 holding bulb 1 arrayed in certain pith each other is constructed into the second concentric ring, in which the both cords 3 led out from the each bulb-holder 2 are bent and twisted together into a proper length of strand cable called longitudinal wire 31, the untwisted cord 3 on the ring is formed to latitudinal wire 32. A rested cord 33 at the last bulb-holder 22 of the second concentric ring extends downward continuously to connect with one terminal of the first bulb-holder (not shown) of the third concentric ring or another terminal of the said plug 4. In this way, along with the increase of the ring number, the length of the cylindrical or the conical lamp network is extended.

In combination, by the cord 3, the bulb-holder 2 in the inner ring is linked to the longitudinal wire 31 or the joint point of the longitudinal wire 31 and the latitudinal wire 32 of the external concentric ring to form a steric retiform lamp.

I claim:

1. A steric retiform lamp comprising a lamp network net having a plurality of bulb-holders with light bulbs and a contour selected from one of cylindrical and conical contours, said lamp network net being formed by a complete cord connecting all of said light bulbs in series; wherein said cord is constructed into multiple concentric lamp ring strings by fastening a start end and a final end of said cord of each concentric lamp ring string together; each bulb-holder of an inner ring is linked to an adjacent external ring in a point to point type connection via cords of predetermined length.

2. The steric retiform lamp as claimed in claim 1, wherein said cord and a portion of said plurality of bulb-holders are connected and formed into said inner ring, wherein one terminal of a first bulb-holder connects to one terminal of a plug via a wire, and another wire from a last bulb-holder extends past said first bulb-holder and is fastened to said first bulb-holder by a fastening component, said other wire then extends downward continuously; said extended other wire with a string of bulb-holders holding light bulbs arrayed in a predetermined pitch forms a second concentric lamp ring string; a wire extending from a last bulb-holder of said second concentric lamp ring string extends downward continuously to connect with one of a terminal of a first bulb-holder of a third concentric lamp ring string or another terminal of said plug.

3. The steric retiform lamp as claimed in claim 1, wherein two wires extending from each bulb-holder of a portion of said plurality of bulb-holders are respectively twisted together along a predetermined length to respectively form longitudinal wires, an untwisted cord of each of said multiple concentric lamp ring strings respectively form latitudinal wires.

4. The steric retiform lamp as claimed in claim 2, wherein two wires extending from each bulb-holder of a second portion of said plurality of bulb-holders are respectively twisted together along a predetermined length to respectively form longitudinal wires, an untwisted cord of each of said multiple concentric lamp ring strings respectively form latitudinal wires.

* * * * *